US007874192B2

(12) United States Patent
Bartlett et al.

(10) Patent No.: US 7,874,192 B2
(45) Date of Patent: Jan. 25, 2011

(54) ARRANGEMENT FOR COOLING A ROLL

(75) Inventors: Michael Charles Richard Bartlett, Old Castle Farm (GB); Steven Phillip Corcoran, Growood (GB)

(73) Assignee: Bartlett Engineering (South Wales) Limited, Port Talbot (GB)

( * ) Notice: Subject to any disclaimer, the term of this patent is extended or adjusted under 35 U.S.C. 154(b) by 311 days.

(21) Appl. No.: 10/511,461

(22) PCT Filed: Apr. 16, 2003 (Under 37 CFR 1.47)

(86) PCT No.: PCT/GB03/01641

§ 371 (c)(1), (2), (4) Date: Mar. 14, 2006

(87) PCT Pub. No.: WO03/089160

PCT Pub. Date: Oct. 30, 2003

(65) Prior Publication Data

US 2006/0162414 A1 Jul. 27, 2006

(30) Foreign Application Priority Data

Apr. 16, 2002 (GB) ..... 0208639.5

(51) Int. Cl.
*B21B 27/06* (2006.01)
*B21D 37/16* (2006.01)
*F28F 5/02* (2006.01)

(52) U.S. Cl. ..... 72/201; 72/342.2; 492/46

(58) Field of Classification Search ..... 72/200, 72/201, 202, 342.2, 342.3, 342.7, 252.5, 72/236, 249; 285/272–282; 492/46, 1
See application file for complete search history.

(56) References Cited

U.S. PATENT DOCUMENTS

| | | | | | |
|---|---|---|---|---|---|
| 1,850,878 | A | * | 3/1932 | Hunt | 72/201 |
| 3,604,237 | A | * | 9/1971 | Kawanami et al. | 72/201 |
| 3,678,226 | A | * | 7/1972 | Hatagi et al. | 191/1 A |
| 3,684,316 | A | * | 8/1972 | Lavender | 285/16 |
| 4,019,846 | A | * | 4/1977 | Greenberger | 425/194 |
| 4,254,972 | A | * | 3/1981 | Wiedenbeck et al. | 285/61 |
| 4,368,895 | A | * | 1/1983 | Okamoto et al. | 277/347 |

(Continued)

FOREIGN PATENT DOCUMENTS

DE 3421753 A 4/1985

(Continued)

*Primary Examiner*—Teresa M Ekiert
(74) *Attorney, Agent, or Firm*—Stites & Harbison PLLC; Richard S. Myers, Jr.

(57) ABSTRACT

The present invention discloses an arrangement for cooling a roll (5). The arrangement comprises a housing (2) to be secured to the roll (5), a hollow shaft (8) mounted for rotational movement within the housing (2) and a cooling medium line to convey cooling medium into the roll (5) via the interior of the shaft(8). The cooling medium line comprising an inlet communicating with an elbow portion, a first length (27) of the elbow portion (20) extending from the inlet substantially perpendicular to the axis of the shaft and a second length (26) of the elbow portion extending from the first length in the direction of the axis of the shaft (8), the axes of the first and second lengths being in substantially the same plane.

23 Claims, 3 Drawing Sheets

U.S. PATENT DOCUMENTS

| | | | | | |
|---|---|---|---|---|---|
| 4,477,107 | A | * | 10/1984 | Ferguson et al. | 285/121.4 |
| 4,635,969 | A | * | 1/1987 | Jackson | 285/95 |
| 4,922,739 | A | * | 5/1990 | Ostertag | 72/80 |
| 5,098,135 | A | * | 3/1992 | Timm | 285/121.3 |
| 5,209,526 | A | | 5/1993 | Beccia et al. | |
| 5,303,959 | A | * | 4/1994 | Medsker | 285/24 |
| 6,126,207 | A | * | 10/2000 | Ives | 285/121.1 |
| 7,150,477 | B2 | * | 12/2006 | Reifschneider et al. | 285/281 |
| 2004/0012199 | A1 | * | 1/2004 | Beach et al. | 285/272 |

FOREIGN PATENT DOCUMENTS

| | | | |
|---|---|---|---|
| DE | 10024556 | A | 11/2001 |
| EP | 1125656 | A2 | 12/2000 |
| GB | 2046386 | A | 11/1980 |
| JP | 2001 225155 | A | 8/2001 |
| WO | WO01/88452 | A1 | 11/2001 |

* cited by examiner

ARRANGEMENT FOR COOLING A ROLL

The present invention relates to an arrangement for cooling a roll.

A roll is typically used to produce steel sheets and the like through rolling of a block of steel. The roll needs to be continuously cooled typically by water or other such cooling liquid flowing along a liquid flowpath between an inlet and an outlet. The liquid flowpath passes within the roll and heat is transferred to the liquid thus cooling the roll.

The cooling liquid inlet and outlet is typically provided by one or more rotational union couplings. Known rotational union couplings comprise a hollow shaft that connects to one or more pipes which transport cooling liquid into or out of the shaft. A housing mounted for rotation about the shaft, is secured to the roll such that the housing rotates as the roll rotates whilst the shaft remains substantially stationary.

In a single flow system, two couplings are connected to the roll. Water or other cooling liquid passes from a pipe into the shaft of one of the couplings and is transported via a delivery line around the internal workings of the roll to the shaft of the other coupling and out of a pipe connected to this shaft.

In a dual flow system, water or other cooling liquid is conveyed into and out of the roll via the shaft of a single coupling connected to the roll. The shaft of a dual flow system coupling has two separate liquid flowpaths therethrough and connection means for both an inlet pipe and an outlet pipe. One of the flowpaths is typically provided by a tube in the interior of the shaft connected to the shaft inlet or outlet, the other flowpath being provided between the external surface of the tube and the internal wall of the shaft.

In both single and dual flow systems, the water or other cooling liquid must be conveyed into a coupling around the roll and out of a coupling at a certain pressure for the system to cool the roll efficiently.

An improved arrangement for cooling a roll has now been devised.

According to the present invention, there is provided an arrangement for cooling a roll, the arrangement comprising a housing to be secured to the roll, a hollow shaft mounted for rotational movement within the housing and a cooling medium line to convey cooling medium into the roll via the interior of the shaft; the cooling medium line comprising an inlet or outlet communicating with an elbow portion, a first length of the elbow portion extending from the inlet or outlet substantially perpendicular to the axis of the shaft and a second length of the elbow portion extending from the first length in the direction of the axis of the shaft, the axes of the first and second lengths being in substantially the same plane.

Preferably the cooling medium line comprises an inlet communicating with the elbow portion.

In a further embodiment of the present invention, there is provided:

(i) a first cooling medium line to convey cooling medium into the roll via the interior of the shaft, the first cooling medium line comprising an inlet communicating with a first elbow portion, a first length of the first elbow portion extending from the inlet substantially perpendicular to the axis of the shaft and a second length of the first elbow portion extending from the first length in the direction of the axis of the shaft, the axes of the first and second lengths being in substantially the same plane; and (ii) a second cooling medium line to convey cooling medium out of the roll via the interior of the shaft, the second cooling medium line comprising an outlet communicating with a second elbow portion, a first length of the second elbow portion extending from the outlet substantially perpendicular to the axis of the shaft and a second length of the second elbow portion extending from the first length in the direction of the axis of the shaft, the axes of the first and second lengths being in substantially the same plane.

The elbow portion conveys cooling medium into and/or out of the arrangement of the present invention via only one right angled turn in a single plane, thus providing little resistance to the flow of cooling medium through the elbow portion. This reduces the pressure drop of the cooling medium through the arrangement of the present invention.

The cooling medium line is preferably substantially cylindrical and the internal wall of the elbow portion preferably has a bend radius between the first length and the second length. The inner radius of the bend radius is suitably more acute that the outer radius.

The substantially cylindrical cooling medium line and the bend radius of the elbow portion provide little resistance to the flow of cooling medium. This further reduces the pressure drop of the cooling medium through the arrangement of the present invention.

The elbow portion preferably includes mounting means for mounting the elbow portion to the shaft. The mounting means is suitably an annular flange provided on the external surface of the first length of the elbow portion, the annular flange being adjacent the external wall of the shaft. The annular flange may be fixed by welding or the like to the external wall of the shaft providing a substantially liquid tight seal. In this arrangement part of the first length of the elbow portion is positioned externally of the shaft.

The first length of the elbow portion extending from the inlet/outlet is preferably provided with external connection means and/or internal connection means for connecting a pipe for conveying cooling medium, the connection means typically comprising a threaded connection that engages a correspondingly threaded pipe connector. It is a preferred feature of the present invention that both external and internal connection means are provided, so that two different types of pipe connectors can be connected to the elbow portion.

The second length of the elbow portion is preferably provided with external connection means and/or internal connection means for connecting a conduit that conveys cooling medium into the roll. Preferably both internal and external connection means are provided so that two different radial sizes of conduit can be connected to the elbow portion. The connection means of the second length of the elbow portion preferably comprises one or more elongate ridges in the direction of the axis of the shaft on the internal and/or external surface of the second length of the elbow portion.

The ridges provide secure engagement of the conduit and act as flow straighteners to straighten the flow of cooling medium through the elbow portion and/or between the elbow portion and the hollow shaft. The ridges also provide little resistance to the flow of cooling medium. This further reduces the pressure drop of the cooling medium through the arrangement of the present invention.

The proximal end of the hollow shaft adjacent the roll when the housing is secured to the roll is open to allow cooling medium to pass into and/or out of the roll. The opposed distal end of the shaft is preferably sealed. The proximal end of the shaft preferably has an annular flange against which the housing abuts. A spacer may be provided between the housing and the annular flange of the shaft so that the positioning of the housing on the shaft can be adjusted to reduce wear.

In a particularly preferred embodiment of the present invention, there is provided a delivery flow path that delivers cooling medium into the roll via the interior of the shaft and a return flow path for outflow of cooling medium via the interior of the shaft. The delivery flow path preferably comprises an inlet communicating with the elbow portion and a conduit connected to the second length of the elbow portion that delivers cooling medium into the roll, whereby at least part of the conduit is positioned in the interior of the hollow shaft along the axis of the shaft; and the return flow path conveys cooling medium between the outer surface of the conduit and the internal wall of the shaft to an outlet.

The conduit is preferably substantially cylindrical to provide little resistance to the flow of cooling medium. This further reduces the pressure drop of the cooling medium through the arrangement of the present invention.

A channel in the shaft communicating with the outlet is preferably provided, a first length of the channel extending from the outlet substantially perpendicular to the axis of the shaft and a second length of the channel extending from the first length in the direction of the axis of the shaft, the axes of the first and seconds lengths of the channel being in substantially the same plane.

The channel conveys cooling medium out of the arrangement of the present invention via only one right angled turn in a single plane, thus providing little resistance to the flow of cooling medium through the elbow portion. This further reduces the pressure drop of the cooling medium through the arrangement of the present invention.

The internal wall of the hollow shaft preferably tapers towards the second length of the channel to funnel cooling medium into the channel.

The walls of the channel are preferably substantially rounded to provide little resistance to the flow of cooling medium through the elbow portion. This further reduces the pressure drop of the cooling medium through the arrangement of the present invention.

The first length of the channel is preferably internally threaded to engage a pipe connector for connecting a pipe to convey cooling medium out of the arrangement of the present invention.

The inlet is suitably positioned further away from the distal end of the shaft than the outlet which is preferably adjacent the sealed distal end of the shaft.

The hollow shaft of the present invention is preferably provided with pressure release means for releasing internal pressure in the shaft when the internal pressure substantially exceed a threshold pressure level. By providing the shaft with a pressure release means, pressure can be released from the arrangement when it exceeds a certain internal pressure threshold level to prevent the whole arrangement of the present invention or the roll from bursting which would be much more costly to replace than simply replacing the shaft if necessary.

The pressure release means is preferably provided by a portion of the shaft having a thinner wall than the wall of remainder of the shaft, the thinner walled portion ideally ruptures when the internal pressure exceeds a threshold pressure level. Whilst this will destroy the integrity of the shaft allowing cooling medium to leak out of the shaft, as only a small portion of the shaft ruptures enough cooling medium is still conveyed to the roll via the interior of the shaft to provide some cooling of the roll until the shaft can be replaced. The thinner walled portion of the shaft is preferably provided by a bore in the wall of the shaft. The bore is preferably positioned adjacent the second aperture providing a thin walled portion between the bore and the channel extending from the second aperture and also a thin walled portion between the bore and the internal hollow of the shaft so that there are two possible points of rupture.

According to a further aspect of the present invention, there is provided an arrangement for cooling a roll, the arrangement comprising a housing to be secured to the roll, a hollow shaft mounted for rotational movement within the housing and a cooling medium line to convey cooling medium into the roll via the interior of the shaft, wherein the shaft is provided with pressure release means for releasing internal pressure in the shaft when the internal pressure substantially exceeds a threshold pressure level.

The preferred features of the pressure release means are substantially as hereinbefore described.

The invention will now be described by way of example only and with reference to the accompanying drawings in which.

Figure 1:
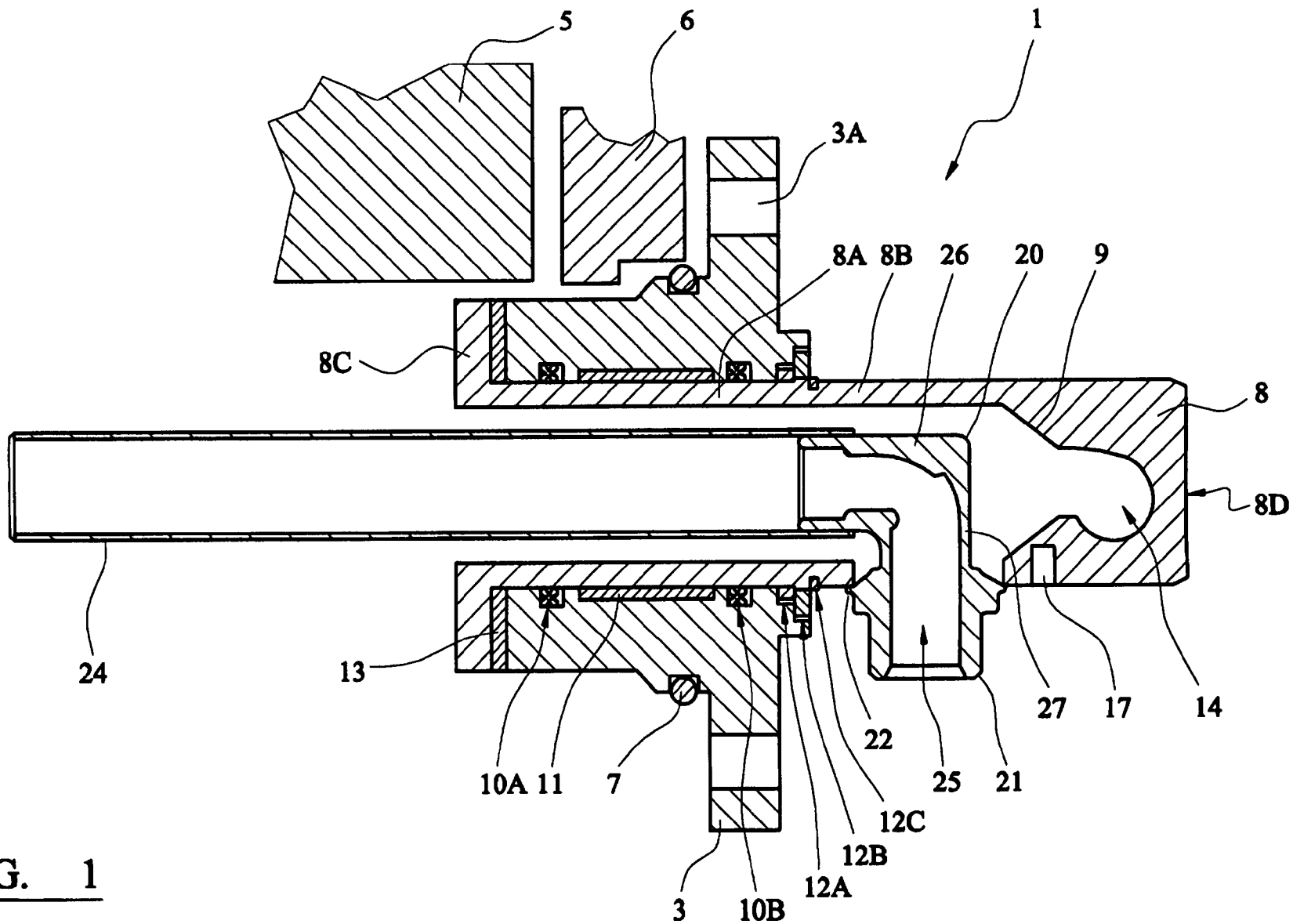
FIG. 1 shows a sectional view of the arrangement of the present invention in use for cooling a roll.

Referring to the drawings and in particular to FIG. 1, there is provided a coupling 1 comprising a cylindrical housing 2 mounted for rotation about a cylindrical hollow shaft 8. A continuous casting roll 5 is supported for rotation by a bearing plate 6 (continuous casting roll 5 and bearing plate 6 are well known in the art and are not described fully herein). Housing 2 has a flange 3 at one end which is designed to be secured to bearing plate 6 (and hence continuous casting roll 5) by bolts passing through flange apertures 3A, whereby housing 2 rotates with the continuous casting roll 5. The rest of housing 2 extending from flange 3 fits inside the continuous casting roll 5 and seal ring 7 provides a substantially liquid tight seal between housing 2 and roll 5.

Cylindrical hollow shaft 8 is sealed at one end 8D. The open end of the shaft has an integral annular flange 8C. Housing 2 fits snugly over a first part 8A of shaft 8 whilst allowing rotation of housing 2 about shaft 8. One end of the housing 2, opposed to the end with flange 3, abuts a spacer 13 which in turn abuts annular flange 8C of shaft 8. The position of the housing 2 on shaft 8A can be adjusted by removing spacer 13 thus reducing wear. A second part 8B of shaft 8 which includes sealed end 8D, projects out of housing 2 away from flange 3.

The annular flange 8C on one side of housing 2 and a spring washer 12A, circlip thrust 12B and circlip 12C on the opposed side of housing 2 prevents lateral movement of housing 2 relative to shaft 8. Quad seals 10A and 10B provide a substantially liquid tight seal between the shaft 8A and housing 2 and a bearing 11 supports the housing 2 for rotation about shaft 8.

Figure 3:
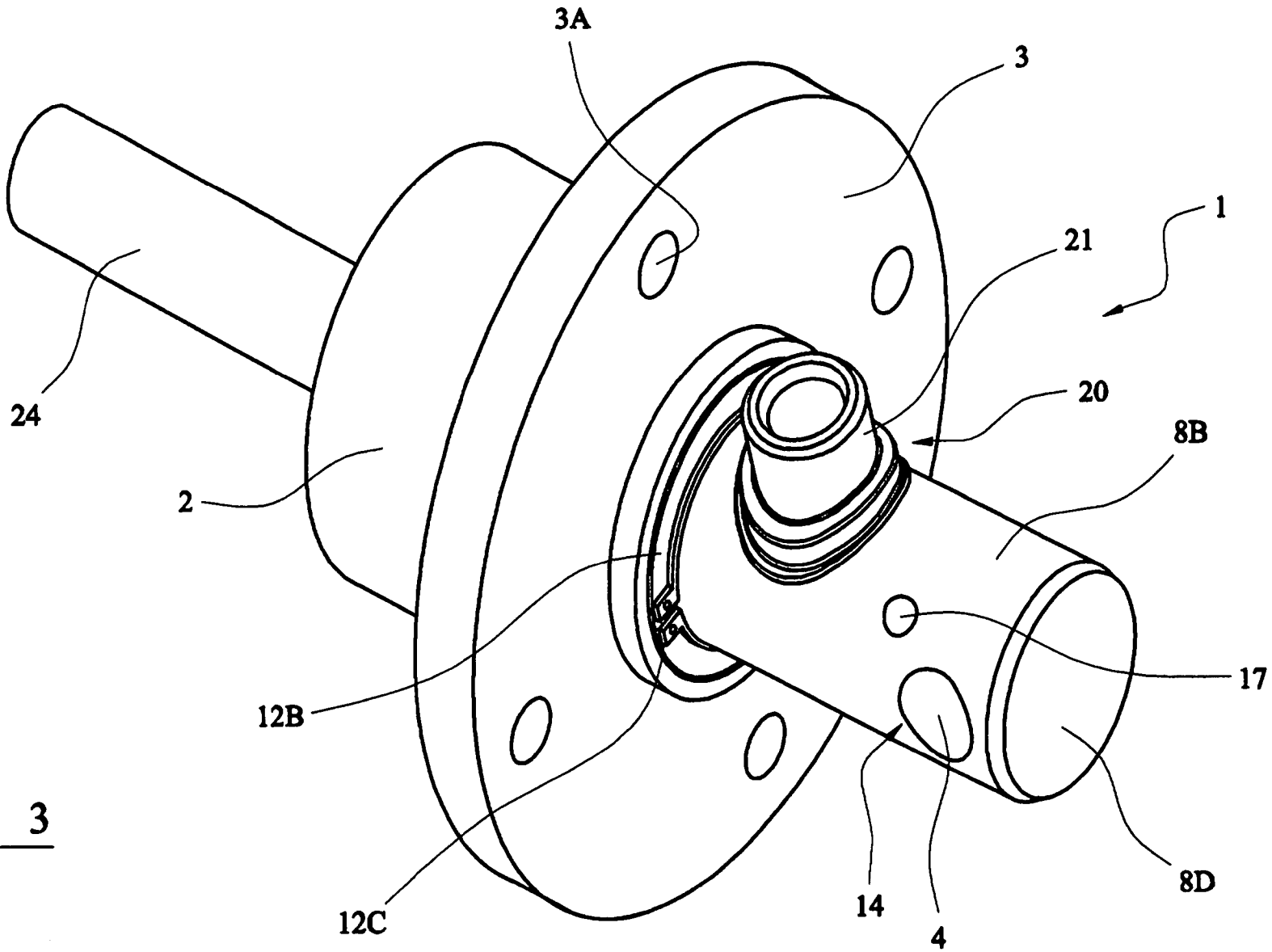
FIG. 3 shows a perspective view of the arrangement of FIG. 1.

Shaft 8 has a first aperture in which an elbow portion 20 is mounted and a second aperture 14 adjacent sealed end 8D. A channel 4 (shown in FIG. 3) which is perpendicular to the axis of shaft 8, extends from second aperture 14 into the hollow interior of shaft 8. Channel 4 may be internally threaded to engage a correspondingly threaded pipe connector. The internal wall of the hollow shaft 8 is tapered 9 towards channel 4 so that channel 4 joins a narrow hollow portion of shaft 8 which opens out into the wider hollow interior of shaft 8.

Elbow portion 20 comprises a first length 27 and a second length 26 perpendicular to the first length. A channel 25 extends through both the first and second lengths 27,26. First length 27 is perpendicular to the axis of shaft 8 and second length 26 is in the direction of the axis of shaft 8. The axes of first and second lengths 27,26 are in the same plane.

Elbow portion 20 has an annular flange 22 provided on the external surface of first length 27, the annular flange 22 being adjacent the external wall of shaft 8. Annular flange 22 may be fixed by welding or the like to the external wall of shaft 8 providing a substantially liquid tight seal. An annular wall 21 of first length 27 is positioned externally of shaft 8. Annular wall 21 may be internal and/or externally threaded to engage a correspondingly threaded pipe connector.

Figure 2A:
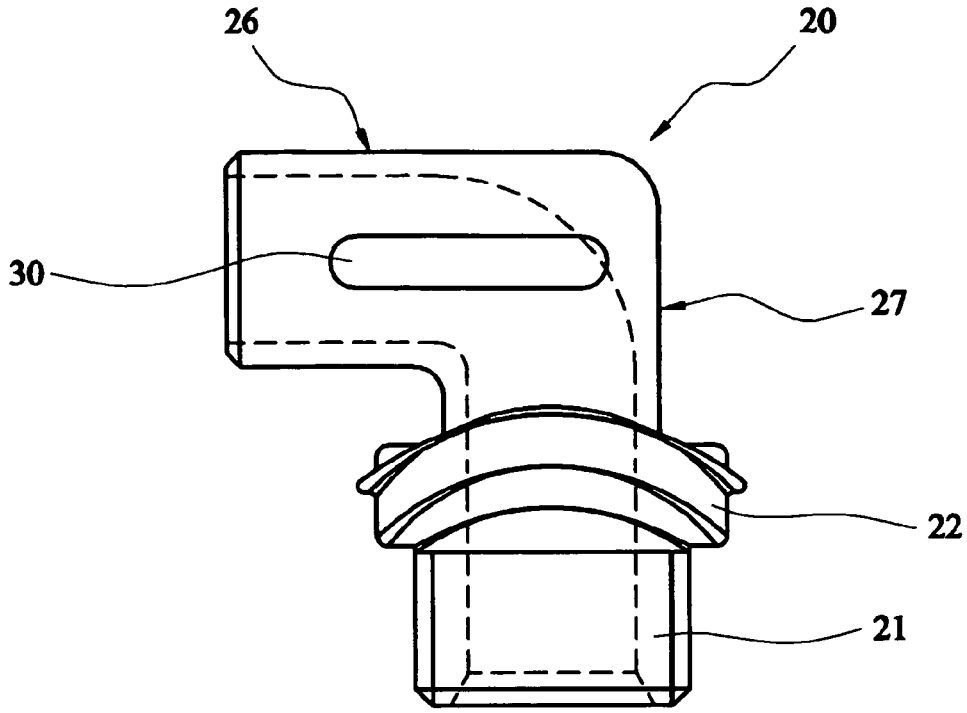
FIG. 2A shows a side view of the elbow portion of FIG. 1.
Figure 2B:
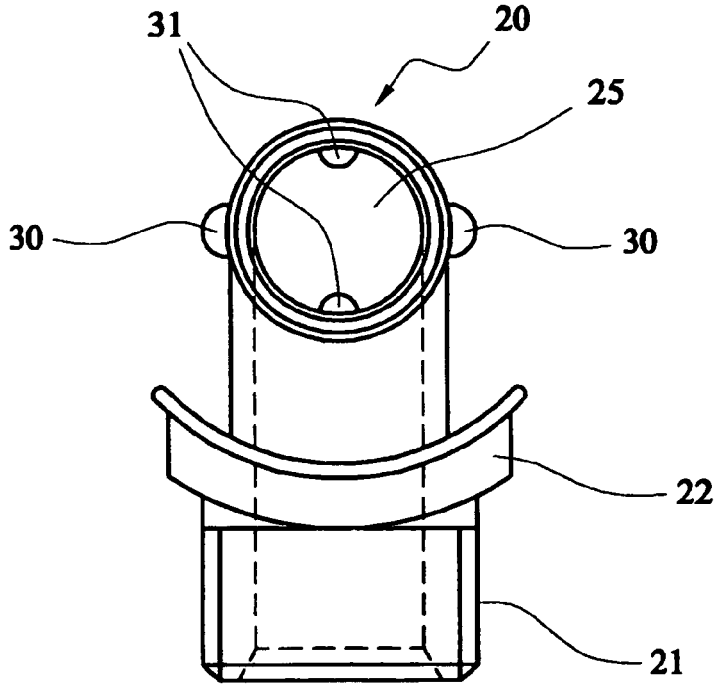
FIG. 2B shows a perspective view of the elbow portion of FIG. 1.

The second length 26 of elbow portion 20 is provided with two elongate ridges 30 in the direction of the axis of the shaft on the external surface of second length 26 and two elongate ridges 31 in the direction of the axis of the shaft on the internal surface of second length 26 (shown in FIGS. 2A and 2B). Ridges 30,31 provide secure engagement of two different radial sizes of conduit whilst providing minimal resistance to the flow of cooling medium through the interior of elbow portion 20 and shaft 8. The ridges 30,31 also act as flow straighteners to straighten the flow of cooling medium through the interior of elbow portion 20 and to straighten the flow of cooling medium between the elbow portion and the interior wall of shaft 8. A conduit 24 engaged with ridges 30 on the external surface of second length 26 is shown in FIG. 1. Conduit 24 extends into roll 5 to convey cooling medium into roll 5.

A bore 17 is provided in the external wall of shaft 8 adjacent second aperture 14. A thin walled portion of shaft 8 is thus provided between the bore 17 and the tapered internal wall 9 of shaft 8 (as shown in FIG. 1). A further thin walled portion of shaft 8 (not shown) is provided between bore 17 and channel 4. These thin walled portions will rupture if the internal pressure inside shaft 8 exceeds a certain threshold level. Whilst this will destroy the integrity of shaft 8 allowing cooling medium to leak out of shaft 8, as only a small portion of shaft 8 ruptures enough cooling medium is still conveyed to roll 5 via the interior of shaft 8 to provide some cooling of roll 5 until the shaft 8 can be replaced.

In use, coupling 1 is mounted at the end of continuous casting roll 5 to provide a dual flow system. Water or other cooling medium flows into the interior of shaft 8 via elbow portion 20, and along conduit 24 into roll 5. Heat from roll 5 is transfer to the water which then flows back between the external surface of conduit 24 and the internal surface of shaft 8 and out through channel 4 and aperture 14. It will be appreciated that the flow path in this arrangement only passes through two right angles turns in a single plane (one turn through elbow portion 20 and one turn through channel 4), thus providing little resistance to the flow of cooling medium. This reduces the pressure drop of the cooling medium through the arrangement of the present invention.

It will be appreciated that because annular wall 21 of elbow portion 20 can receive two different sizes of pipe connectors and second length 26 of elbow portion 20 can receive two different radial sizes of conduits 24, the arrangement of the present invention can fit different sizes of pipes and conduits used in industry.

Coupling 1 may take a form different to that specifically described above and may be made of any suitable material.

The arrangement of the invention may be used with known driven and non-driven rolls. The diameter and/or length of a continuous casting roll will not affect the performance of the arrangement.

Further modification will be apparent to those skilled in the art without departing from the scope of the present invention.

The invention claimed is:

1. An arrangement for cooling a roll, the arrangement comprising:

a housing to be secured to the roll, the housing mounted for rotation about a hollow shaft of the roll, the shaft having a length and a longitudinal axis;

a cooling medium delivery flowpath being provided in an elongate cooling medium line conduit extending into the roll and delivering cooling medium into the roll;

a return flowpath for outflow of cooling medium out of the roll to an outlet such that at least part of the elongate cooling medium line conduit is positioned in the interior of the shaft along the longitudinal axis of the shaft, wherein the return flowpath is defined between an outer surface of the elongate cooling medium line conduit and an internal surface of the shaft;

wherein the elongate cooling medium line conduit is connected to an elbow portion, a first length of the elbow portion extending from an inlet substantially perpendicular to the longitudinal axis of the shaft and a second length of the elbow portion extending from the first length in the direction of the longitudinal axis of the shaft, the elongate cooling medium line conduit being connected to the second length of the elbow portion; and wherein the elongate cooling medium line conduit and the elbow portion remain stationary as the housing rotates.

2. An arrangement according to claim 1, wherein the elongate cooling medium line conduit comprises the inlet.

3. An arrangement according to claim 1, wherein the axes of the first and second lengths are in substantially the same plane.

4. An arrangement according to claim 1, wherein an internal wall of the elbow portion has a bend radius between the first length and the second length.

5. An arrangement according to claim 1, wherein the elbow portion includes mounting means for mounting the elbow portion to the shaft.

6. An arrangement according to claim 5, wherein the mounting means is an annular flange provided on an external surface of the first length of the elbow portion, the annular flange being adjacent an external wall of the shaft.

7. An arrangement according to claim 1, wherein the first length of the elbow portion is provided with external connection means and/or internal connection means for connecting a pipe for conveying cooling medium.

8. An arrangement according to claim 7, wherein the first length is provided with both external and internal connection means.

9. An arrangement according to claim 7, wherein the connection means comprises a threaded connection that engages a correspondingly threaded pipe connector.

10. An arrangement according to claim 1, wherein the second length of the elbow portion is provided with external connection means and/or internal connection means for connecting a conduit that conveys cooling medium.

11. An arrangement according to claim 10, wherein the second length is provided with both internal and external connection means so that two different radial sizes of conduit can be connected to the elbow portion.

12. An arrangement according to claim 10, wherein the connection means comprises one or more elongate ridges in the direction of the axis of the shaft on the internal and/or external surface of the second length of the elbow portion.

13. An arrangement according to claim 1, wherein the elongate cooling medium line conduit is substantially cylindrical.

14. An arrangement according to claim 1, wherein the distal end of the shaft is sealed.

15. An arrangement according to claim 1, wherein the proximal end of the shaft has an annular flange against which the housing abuts.

16. An arrangement according to claim 15, wherein a spacer is provided between the housing and the annular flange of the shaft so that the positioning of the housing on the shaft can be adjusted.

17. An arrangement according to claim 1, including a channel in the shaft communicating with the outlet, a first length of the channel extending from the outlet substantially perpendicular to the axis of the shaft and a second length of the channel extending from the first length in the direction of the axis of the shaft, the axes of the first and seconds lengths of the channel being in substantially the same plane.

18. An arrangement according to claim 17, wherein the internal wall of the hollow shaft tapers towards the second length of the channel.

19. An arrangement according to claim 17, wherein the walls of the channel are substantially rounded.

20. An arrangement according to claim 17, wherein the first length of the channel is internally threaded for engagement of a pipe connector.

21. An arrangement according to claim 1, wherein the shaft is provided with pressure release means for releasing internal pressure in the shaft when the internal pressure substantially exceeds a threshold pressure level.

22. An arrangement according to claim 21, wherein the pressure release means is provided by a portion of the shaft having a thinner wall than the wall of remainder of the shaft, the thinner walled portion being arranged to rupture when the internal pressure exceeds a threshold pressure level.

23. An arrangement according to claim 22, wherein the thinner walled portion of the shaft is provided by a bore in the wall of the shaft.

* * * * *